US007895959B1

(12) United States Patent
Angel et al.

(10) Patent No.: US 7,895,959 B1
(45) Date of Patent: Mar. 1, 2011

(54) DIFFERENTIAL TILLER ARMS FOR MARINE VESSELS

(75) Inventors: Bruce A. Angel, New Bern, NC (US); Glenn Lyle Spain, New Bern, NC (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 12/238,019

(22) Filed: Sep. 25, 2008

Related U.S. Application Data

(60) Provisional application No. 60/975,378, filed on Sep. 26, 2007.

(51) Int. Cl.
*B63H 25/06* (2006.01)

(52) U.S. Cl. ..... 114/163

(58) Field of Classification Search ..... 114/162, 114/163, 164, 165
See application file for complete search history.

(56) References Cited

U.S. PATENT DOCUMENTS

| | | | | |
|---|---|---|---|---|
| 102,559 | A * | 5/1870 | Law | 114/165 |
| 161,140 | A * | 3/1875 | McEntire | 114/165 |
| 682,476 | A * | 9/1901 | Marolf | 114/164 |
| 2,527,362 | A | 10/1950 | Hussa | |
| 3,009,435 | A * | 11/1961 | Horton, Jr. | 114/163 |
| 3,147,730 | A * | 9/1964 | Specht | 114/163 |
| 3,710,749 | A | 1/1973 | Duryea | |
| 3,872,817 | A | 3/1975 | Duryea | |
| 4,082,053 | A | 4/1978 | Woodward | |
| 4,444,145 | A | 4/1984 | Kohl | |
| 4,919,630 | A | 4/1990 | Erdberg | |
| 5,445,100 | A | 8/1995 | Finkl | |
| 6,415,729 | B1 | 7/2002 | Nedderman, Jr. et al. | |
| 7,267,588 | B1 | 9/2007 | Griffiths et al. | |

* cited by examiner

*Primary Examiner* — Lars A Olson
(74) *Attorney, Agent, or Firm* — Malin Haley DiMaggio Bowen & Lhota, P.A.

(57) ABSTRACT

Advanced steering system designs for marine vessels which incorporate non-linear tiller arms for rudder control, designed for creating different turning radii for discrete rudders. Differential tiller anus are utilized to create distinct angular displacement of the separate rudders in turning maneuvers, which enhance control and maneuverability of the marine vessels.

4 Claims, 6 Drawing Sheets

DIFFERENTIAL TILLER ARMS FOR MARINE VESSELS

CROSS REFERENCE TO RELATED ED APPLICATIONS

This utility application claims priority on and from U.S. Provisional Patent Application Ser. No. 60/975,378 filed on Sep. 26, 2007.

STATEMENT REGARDING FEDERALLY SPONSORED RESEARCH OR DEVELOPMENT

N/A

BACKGROUND OF THE INVENTION

1. Field of the Invention

The present invention relates generally to steering systems for multi-rudder marine vessels, and more particularly to advanced steering system designs which incorporate non-linear tiller arms for rudder control.

2. Description of the Prior Art

Conventional steering and rudder designs for marine vessels, and particularly monohull power boats having two or more rudders, utilize generally straight tiller arms which are linear and parallel with respect to a vessels centerline in a forward cruising mode. The tiller is attached to rudder stock and control movement of the rudder. A hydraulic or ram actuator acts upon and moves one tiller arm, which in turn acts upon and moves the second tiller arm via the tie-bar or mechanical linkage. As the tillers, rudders and linkage assembly are generally rectangularly symmetrical, when the steering system for the boat is used in maneuvering to turn the boat through water, the rudders likewise turn through the same angular displacement, and there is no compensation for different placement of the rudders in starboard and port locations about the hull, nor for differences in hydrodynamic forces acting upon the distinct rudders.

U.S. Pat. No. 7,267,588 issued to Griffiths et al. discloses Selectively Lockable Marine Devices. This steering system includes a mechanical connecting linkage for controlling two separate marine propulsion devices or engines for power boats. First and second actuators are connected to first and second propulsion units to cause them to rotate about their individual axis. The connecting link has two selectable conditions, and can be locked in a stable condition, to cause synchronous rotation or alternatively to allow the units to rotate independently of one another. There is no rudder controls addressed as set forth in Applicants' instant invention for inboard power vessels.

U.S. Pat. No. 4,919,630 issued to Erdberg, is entitled Inboard Drive System For A Marine Craft, and teaches of a conventional drive system for high performance inboard power boats. Multiple propellers and rudders are utilized, along with a T-shaped steering strut assembly projecting outwardly from the rear of the transom. This supports two cooperatively positioned rudder elements secured aft of the respective propellers. The steering strut unit incorporates conventional/straight tiller arms, tie-bar and conventional rectangularly symmetrical design as show in FIG. 4.

U.S. Pat. Nos. 6,415,729; 4,444,145 and 4,082,053 each related to mutli-rudder vessels having different types of linkage assemblies for acting upon the separate rudders in turning maneuvers. None of these references address a system incorporating differential tiller arms of any type.

The prior art, however, fails either alone or in combination with other references, to teach or suggest the Applicants' engineering designs for advanced steering system designs which incorporate non-linear tiller arms for rudder control, nor any similar or related structure, which was designed for creating different turning radii for discrete rudders. In fact, the prior art fails to address this phenomenon as Applicants have, and therefore does not provide the solutions set forth herein. Differential tiller arms are utilized to create distinct angular displacement of the separate rudders in turning maneuvers. The prior art does not disclose or illustrate the mechanical components of the instant invention, and likewise does not address the particular problems Applicants have solved with the described designs.

SUMMARY OF THE INVENTION

The differential tiller arms illustrated in this invention are designed to enhance overall vessel performance, steering control, and handling. The described tiller aim assists to eliminate rudder stalling when marine vessel's turn on plane by creating differential rudder angles with respect to a vessel's centerline. Conventional linear tiller arms do not account for differential steering, where a cylinder actuator relays transverse displacement of a single tiller arm/rudder, which is then translated proportionally to an adjacent tiller arm/rudder assembly via a tie bar. With parallel rudder angles of linear arms, a single rudder will commonly experience stalling where pressure gradients on either side of the rudder induce loss of control. The differential tiller arm is designed with a slight angle shifted outboard, which induce a difference in rudder angle between two rudders connected with a tie bar. With varied rudder angles, the turning radius of each rudder is centered on a common point at which the vessel is turning, due to the differential rudder angles with respect to a vessel's centerline. For example, when an operator induces the cylinder actuator a starboard turn of 45 degrees to the starboard rudder, the differential tiller arms allow transverse displacement so that the port rudder is rotated approximately 38.9 degrees. As previously discussed, the varied rudder angles allow for smoother transition in turns, minimizing the opportunity of a single rudder stall.

BRIEF DESCRIPTION OF THE DRAWINGS

The invention may be better understood by reference to the drawings in which.

DETAILED DESCRIPTION OF PREFERRED EMBODIMENTS

Typical multiple rudder marine steering systems utilize a single hydraulic ram to apply force to one of two straight tiller arms. This force is transferred via a mechanical link to the other straight tiller arm. Thus, both rudders undergo the same degree of rotation relative to ship center line with ram input. However, due to the athwartship distance between rudders it is desirable for the rudders to follow different paths when the vessel is turning. In an ideal turn the inboard rudder will follow a path with a smaller radius (of distance proportional to the athwart ship distance between rudders) than the outboard rudder. Without this variation in rudder angle the hydrodynamic pressure gradients surrounding the rudder can exceed local vapor pressure resulting in rudder stall, excessive drag, and unpredictable maneuvers. Thus many conventional steering systems add some degree of rudder toe-in to simulate the desired effect of variable rudder angle. However, this toe-in increases resistance in all rudder positions, and often does not accomplish the ideal independent rudder positions desired in all maneuvers.

Figure 1:
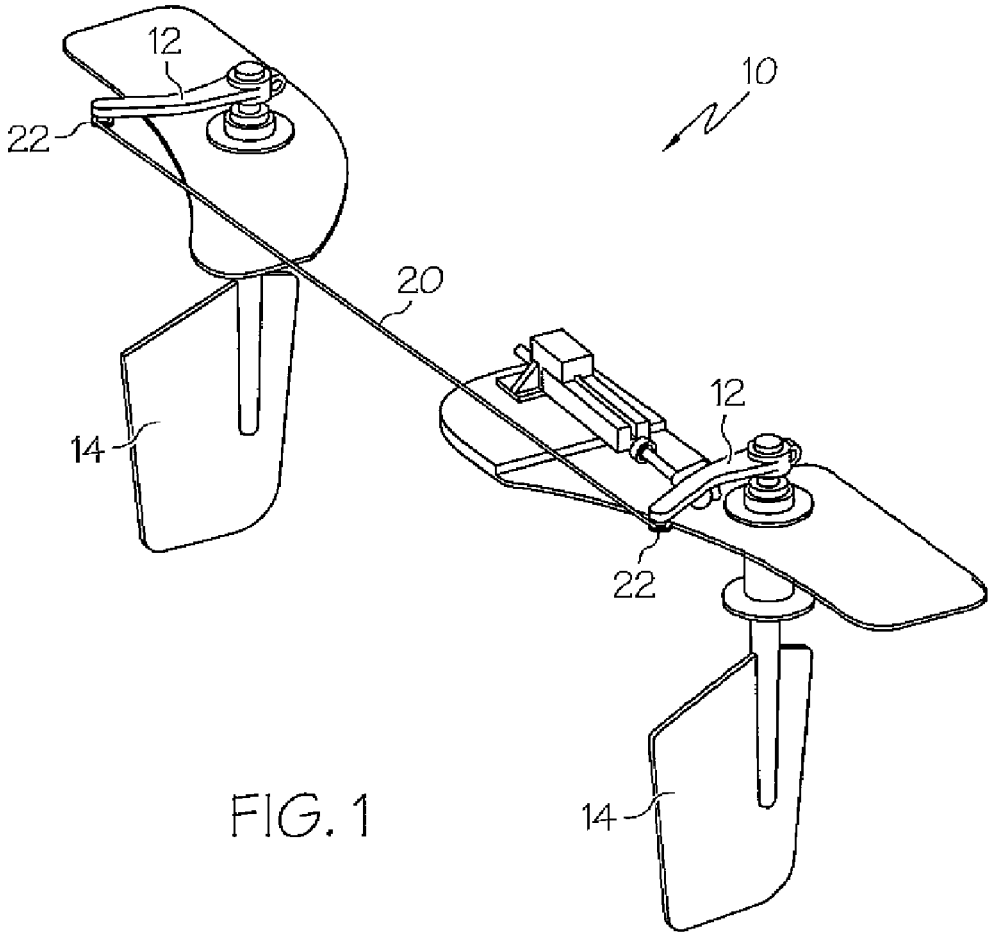
FIG. 1 is a perspective and isometric view of differential tiller arms utilized in the instant steering system for marine vessels.

With reference to FIG. 1, the instant differential tiller aim steering system 10 is illustrated. The unique differential tiller arms 12 enhance the boat maneuverability and turning performance. Typical linear tiller arms as discussed above do not include any provisions to account for the different turning radii required to optimize performance of each rudder. The differential tiller arm 12 allows each rudder 14 to traverse individual turning circles, which share a common axis of rotation. This tiller arm incorporates two hardware attachment locations similar to a conventional tiller arm.

Figure 2A:
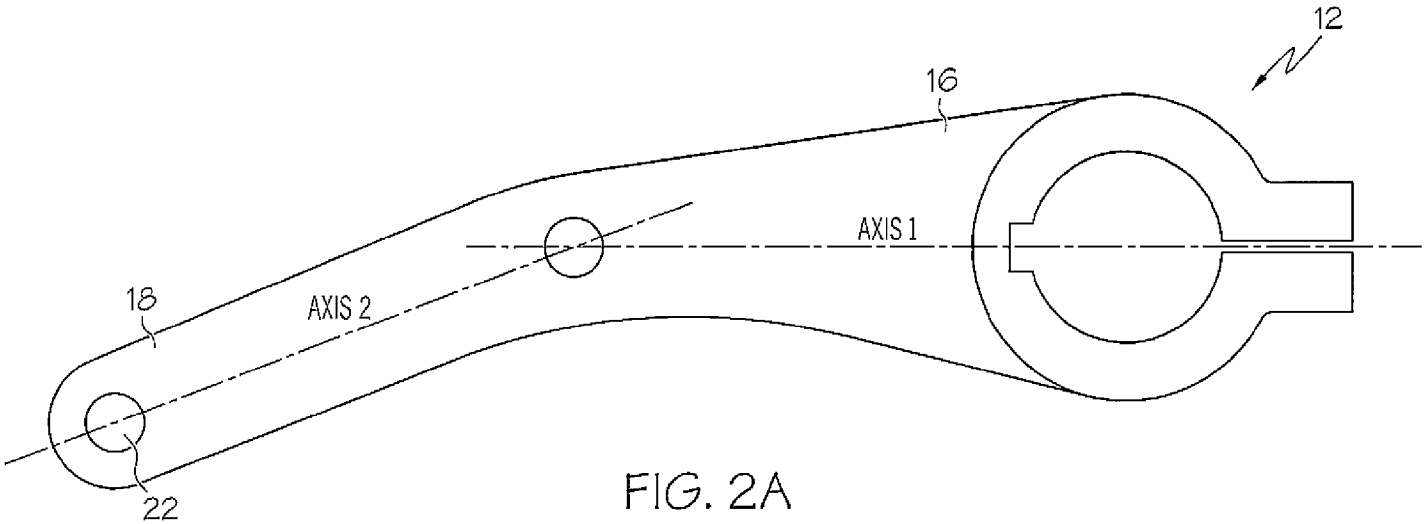
FIG. 2 is a detailed top plan view and front plan view of a differential tiller arm of the instant invention.
Figure 2B:
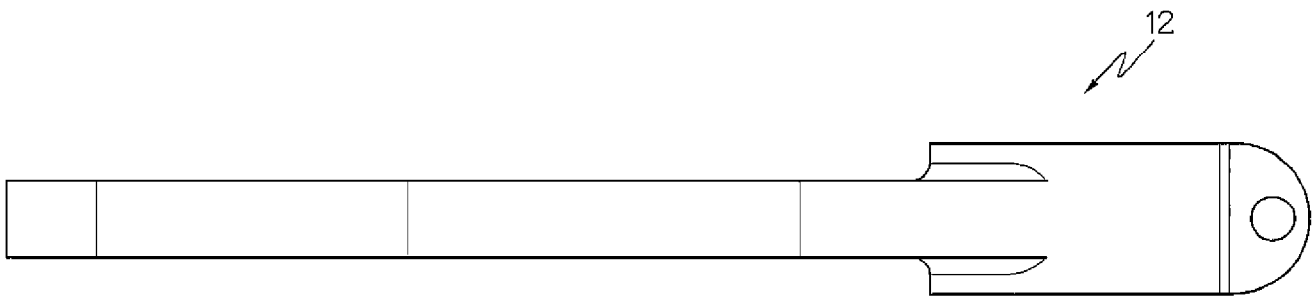

With reference to FIG. 2, tiller aim 12 has a first section or member 16 defining a first axis, and a second section or member 18 defining a second axis. Members 16 and 18 are angularly offset from one-another with respect to the first axis and the second axis.

Figure 3:
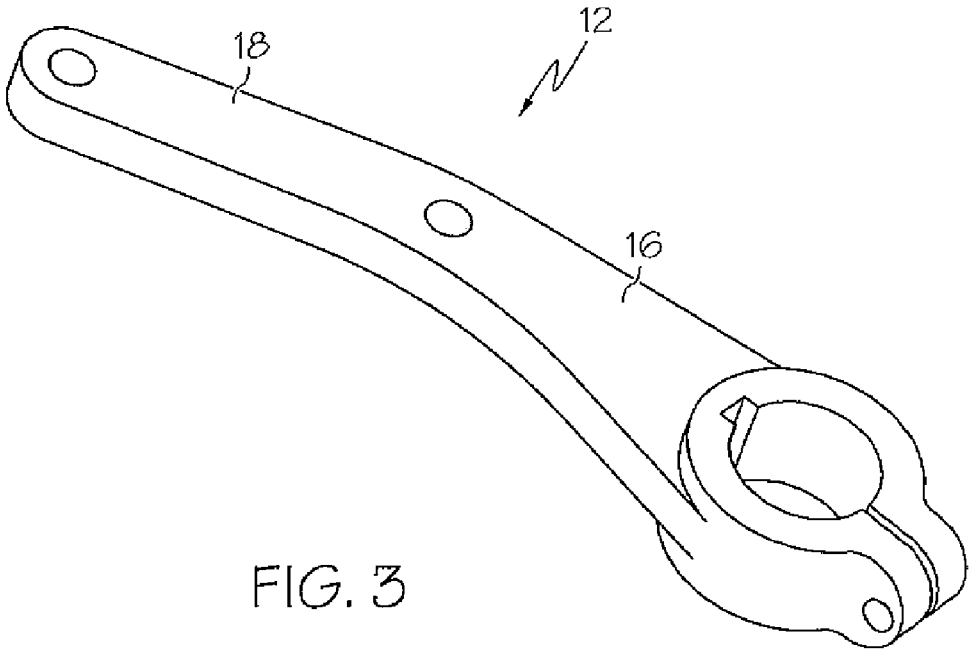
FIG. 3 is a perspective and isometric view of a differential tiller arm.

FIG. 3 depicts an isometric view of an embodiment of the differential tiller arm, illustrating the angular offset of the first and second members.

Figure 4:
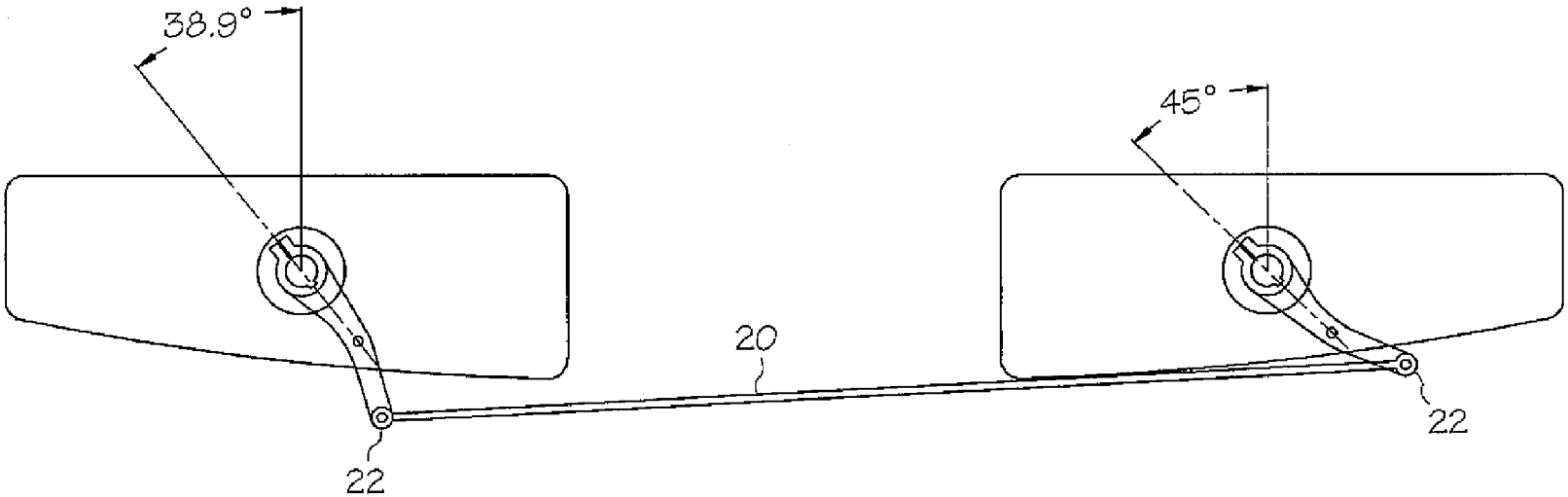
FIG. 4 is a diagrammatic and top plan view of multiple differential tiller arms and differential rudder angles created in turning maneuvers.

The ram attaches conventionally in line with the rudder stock with respect to the ship center line, as seen in both FIGS. 1 & 4. However, the tie bar 20 and its attachment points 22 are not inline with ship centerline and the rudder stock as seen in FIGS. 1, 2 and 4. The offset distance relative to ship centerline is a function of the athwartship distance between rudders. This offset requires the tie bar ends to traverse independent arcs so that the angular relation of the tie bar and ship center line varies as the tiller arms move. Thus, as the tie bar angle changes relative to ships centerline the athwartship distance between tie bar ends changes proportionally. This variation in athwartship distance between tie bar ends results in the desired individual turning radii of each rudder as can be seen in FIG. 4. The port rudder is angled 38.9 degrees from the vessel centerline, and the starboard rudder is simultaneously angled 45 degrees from the vessel centerline. Use of the differential tiller arm does not compromise any other steering component operability, and may be easily retrofitted for any twin engine vessel with linear steering arms with a slight adjustment of the tie bar. Reference FIG. 1 for a typical steering assembly retrofitted with the differential tiller arms.

Figure 5:
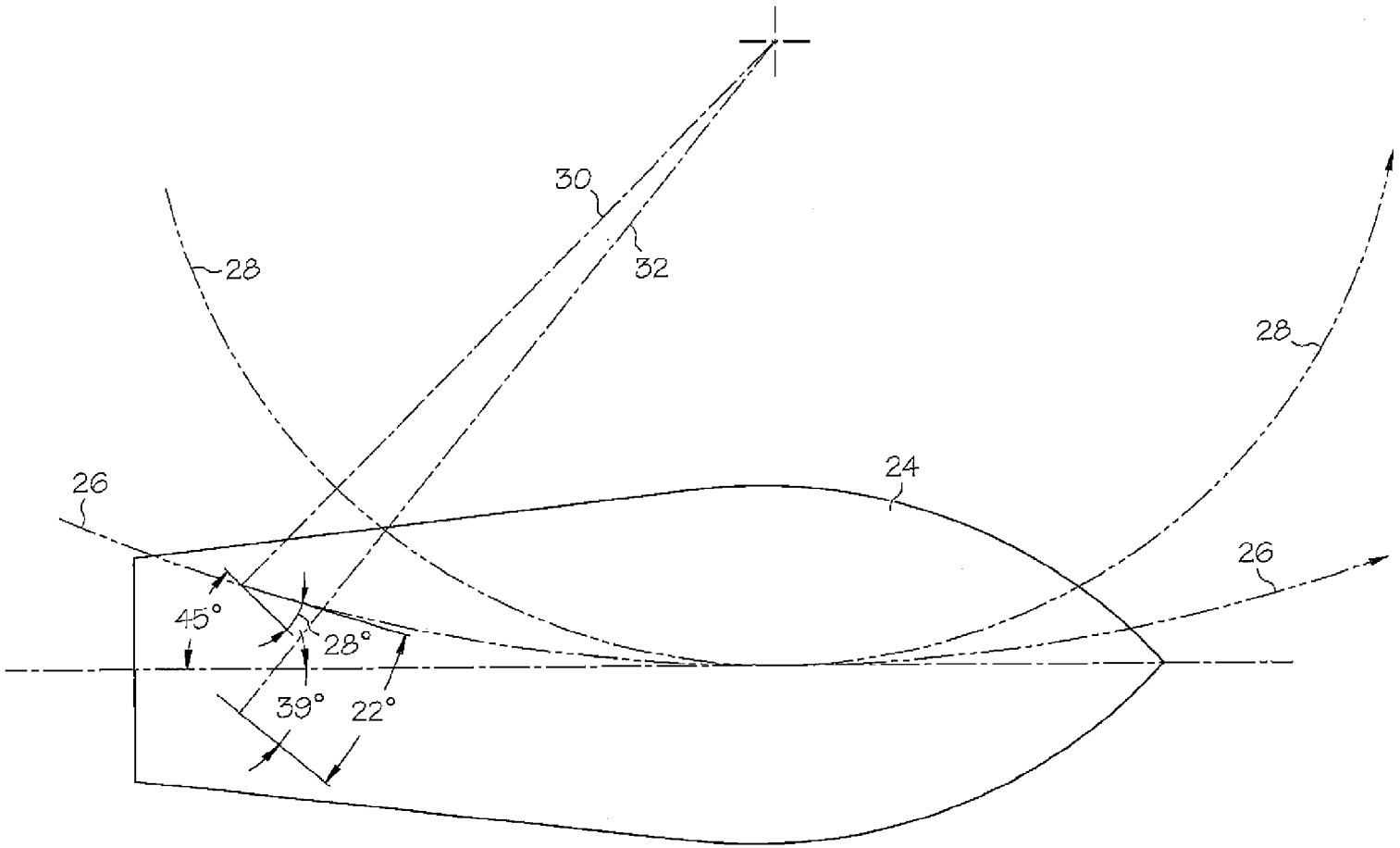
FIG. 5 is a diagrammatic representation of vessel course utilizing the instant invention.

FIG. 5 illustrates the various turning radii of vessel 24. The theoretical turning radius 28, is contrasted with the actual turning radius 26 of the instant invention, resulting from the difference in rudder angles 30 and 32.

Figure 6A:
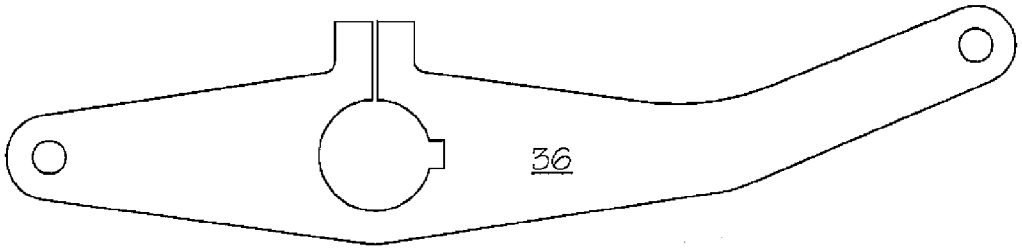
FIG. 6 is a top plan view of alternative embodiments of the tiller arms of the instant inventions.
Figure 6B:
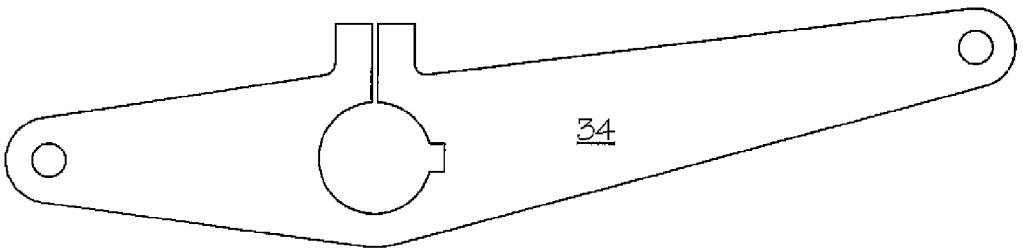

FIG. 6 shows variations in designs and alternative embodiments for differential tiller arms 34 and 36. One skilled in the art appreciates the variations of angular relationships, structural and geometric designs which can be configured into the tiller arms.

Figure 7:
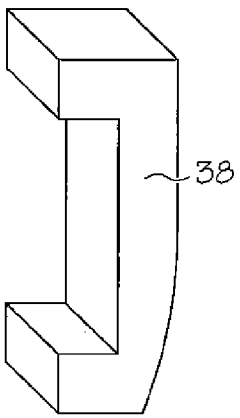
FIG. 7 is perspective view of the interlocking key of the instant invention.

FIG. 7 depicts interlocking key, which fits into the keyway of the differential tiller arm to hold and secure the arrn on rudder stock ears on top and bottom to insure the key does not detach.

Differential steering is not a new concept; Applicants' innovation is the method and tiller design used to obtain it and maintain a conventional hydraulic ram actuator installation. By placing an angle in the end of the tiller arm between the ram attachment point and the tie bar attachment point the ram is rectangular to the rudders but the tie bar is not, this allows for the following advantages, benefits and optimum performance:

1) This design permits the inboard rudder to turn sharper than the outboard rudder while still having the same steering cylinder travel in each direction; therefore the port turn radius is similar to the starboard turn radius.
2) The tiller arms provide differential steering without requiring the ram to be located at odd angles to the rudder stock. This permits the differential steering system to be applied or retrofit to an existing steering system with minimal changes to the hardware. The tiller arm and tie bar are the only parts requiring replacement.
3) This design insures the steering ram applies nominally the same amount of force on the rudder system in each direction.
4) Additional fine tuning can be accomplished by adjusting the tie bar length to increase or decrease rudder toe and that in turn controls the difference in angle from the inboard to outboard rudders in a tight turn.
5) System can be assembled with the differential tiller facing forward or aft with the arms turned inboard or outboard depending on the specific results desired.
6) The differential tiller arms can be identical so only one pattern is required and they can be installed port or starboard with the steering cylinder located on the port or starboard side as well.
7) The ram can be installed on the inboard side of the tiller arm or outboard side for the same effect.
8) A variation of this design includes a differential tiller where the steering cylinder is installed on the opposite side of the rudder stock from the tie bar. In this configuration the differential tiller arm would have an additional arm extending from the rudder stock away from the original arm and at an angle equal to the relative angle between the steering cylinder attachment point and the tie bar attachment point as related to the rudder stock plus 180 degrees.
9) The vessel banks into the turn pushing the inboard rudder deeper below the water surface, at deeper depths below the surface a rudder can be turned to a greater angle of attack without ventilating. Using the differential tillers the inboard rudder turns to a greater angle of attack providing more yaw or turning force than the outboard rudder.
10) A further component of this invention is the "U" shaped key used to secure the rudder to the rudder stock. This key is cut in such a form to wrap around the upper and lower edges of the differential tiller arm and capture the key so it cannot be removed unless the arm is removed from the rudder stock. This device insures that the differential tiller arm stays rotationally attached to the rudder stock.

As will be appreciated by designers in this field, it is possible to utilize one (1) differential tiller arm for one rudder, and one (1) conventional tiller arm for a second rudder. This would entail slight accommodations for the tie-bar and interconnections, and would create an off-set in the respective angular relationship of the separate rudders in turning maneuvers. However, Applicants' preferred embodiments utilize two (2) differential filler arms as illustrated in FIG. 4.

The instant description, drawings and artistic renditions illustrate to one of ordinary skill in the art, how to manufacture, assemble and utilize the instant differential tiller arm steering system for marine vessels. Obvious modifications will occur to those skilled artisans, and are deemed to be within the inventive aspects disclosed herein.

What is claimed is:

1. An advanced steering system for a marine vessel having a plurality of rudders, comprising:

a rudder assembly including an actuator and a plurality of rudders;

a non-linear tiller arm for rudder control;

said non-linear tiller arm having a first member defining a first generally linear axis;

said non-linear tiller arm having a second member defining a second generally linear axis;

said first member and said second member being angularly offset from one-another with respect to said first axis and said second axis;

a tie bar, said tie bar for connection to said non-linear tiller arm;

said non-linear tiller arm having a means for connection to said rudder assembly at one end, and a means for connection to said tie bar at the opposing end; and upon operation of said actuator, said non-linear tiller arm rotates causing said plurality of rudders to rotate in separate and distinct angular displacements.

2. The apparatus of claim 1 further comprising:

a pair of non-linear tiller arms for rudder control;

each said non-linear tiller arm having a first member defining a first generally linear axis, and a second member defining a second generally linear axis; and each said first member and said second member being angularly offset from one-another with respect to said first axis and said second axis; and said tie bar being connected to each said non-linear tiller arm.

3. An advanced steering system for a marine vessel, comprising:

a rudder assembly secured to said marine vessel;

said rudder assembly including an actuator and a pair of rudders;

a pair of differential non-linear tiller arms for rudder control;

each said differential non-linear tiller arm having a first member defining a first generally linear axis, and a second member defining a second generally linear axis;

each said first member and said second member being angularly offset from one-another with respect to said first axis and said second axis;

a tie bar, said tie bar being attached to each said differential non-linear tiller arm;

said actuator controlling movement of at least one said differential non-linear tiller arm, in turn causing movement of the other said differential non-linear tiller arm through said tie bar attachment;

wherein rotation of said differential non-linear tiller arms causes differential and individual rotation of said pair of rudders; and upon operation of said actuator, said rotation of said differential non-linear tiller arms causes said pair of rudders to rotate in separate and distinct angular displacements.

4. The apparatus of claim 3 further comprising:

an interlocking key, said interlocking key securing said differential non-linear tiller arm to said rudder assembly.

* * * * *